United States Patent [19]

Kolze et al.

[11] 4,377,115

[45] Mar. 22, 1983

[54] FURNACE FOR BURNING PARTICULATE WOOD WASTE MATERIAL

[76] Inventors: Bruce A. Kolze, 10356 San Carlos Dr.; Melvin W. Kolze, 10302 Don Pico Rd., both of Spring Valley, Calif. 92077

[21] Appl. No.: 292,020

[22] Filed: Aug. 11, 1981

Related U.S. Application Data

[62] Division of Ser. No. 105,891, Dec. 21, 1979, Pat. No. 4,307,702.

[51] Int. Cl.[3] ..... F23B 7/00

[52] U.S. Cl. ..... 110/234; 110/254; 110/186; 110/251; 126/163 R

[58] Field of Search ..... 110/233, 234, 248, 251, 110/254, 186; 126/101, 163 R, 152 R

[56] References Cited

U.S. PATENT DOCUMENTS

| | | | |
|---|---|---|---|
| 182,999 | 10/1871 | Gwynn | 126/168 |
| 652,924 | 7/1900 | Reed et al. | 110/300 |
| 708,938 | 9/1902 | Taylor | 126/152 R |
| 2,226,048 | 12/1940 | Campbell | 126/163 R |
| 3,669,041 | 6/1972 | Schworer | 110/234 |
| 3,717,938 | 2/1973 | Sylvest | 34/168 |
| 3,785,304 | 1/1974 | Stookey | 110/234 |
| 3,831,535 | 8/1974 | Boardson | 110/233 |
| 3,865,053 | 2/1975 | Kolz et al. | 110/186 |
| 3,955,512 | 5/1976 | Martin et al. | 110/254 |
| 4,081,237 | 3/1918 | Wright | 432/3 |
| 4,091,748 | 5/1978 | Mansfield | 110/234 |
| 4,101,265 | 7/1978 | Broach et al. | 34/86 |
| 4,186,668 | 2/1980 | Tobel | 110/251 |
| 4,311,102 | 1/1982 | Kolze et al. | 110/186 |

FOREIGN PATENT DOCUMENTS

| | | | |
|---|---|---|---|
| 451617 | 8/1936 | United Kingdom | 110/234 |

*Primary Examiner*—Henry C. Yuen

*Attorney, Agent, or Firm*—Hill, Van Santen, Steadman, Chiara & Simpson

[57] ABSTRACT

A furnace for burning dry or wet wood waste products such as hogged bark and the like is provided with a grating therein comprised of aligned rows of bricks resting on supporting cross beams, with at least some of the rows of bricks maintained a uniform distance from other rows of bricks by spacers disposed between such spaced-apart rows of bricks. The furnace is charged by turbulent air entering both above and below the grating, with a select portion of such air being pre-heated. A temperature gradient is established between an area immediately beneath the grating and the area above the grating in the range of 2200° F. and can be controlled by selected initial placement of the bricks and spacers to achieve an optimum cross sectional area for flow of heated, turbulent air through the grating to produce a temperature for efficient heating, drying and burning of wood waste products in an essentially pollution-free manner.

6 Claims, 5 Drawing Figures

FIG. 3
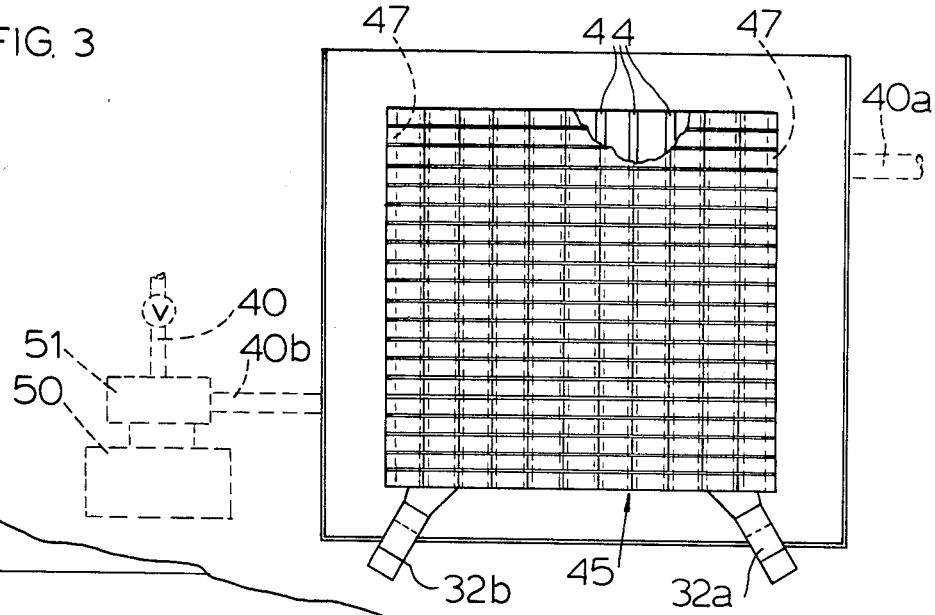
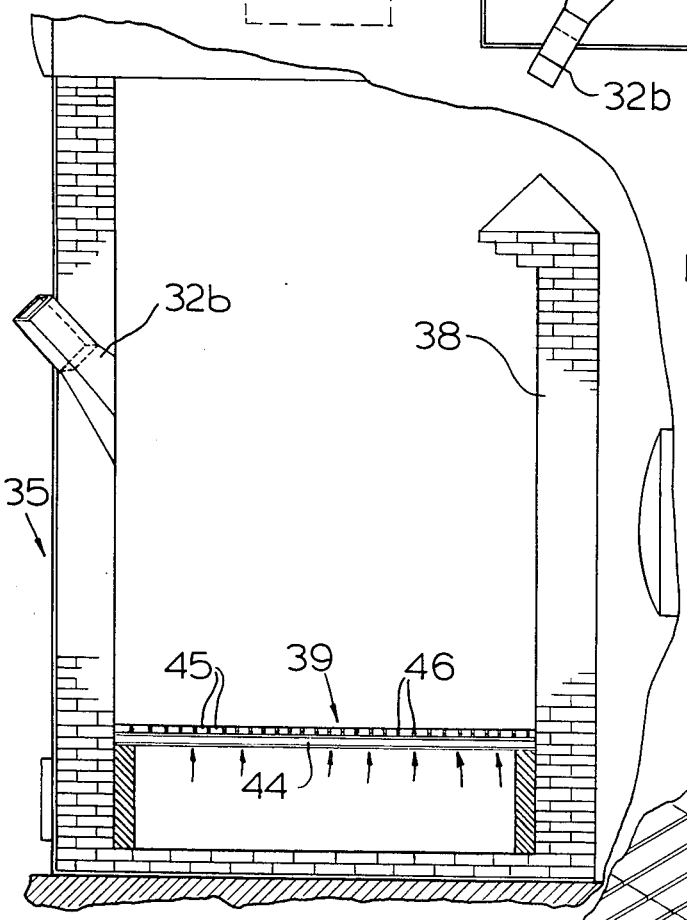
FIG. 4
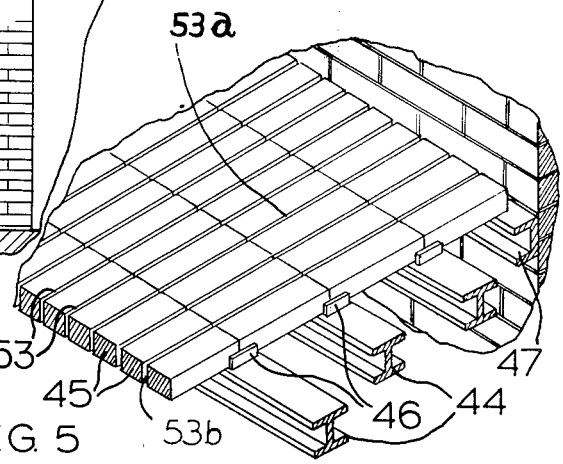
FIG. 5

FURNACE FOR BURNING PARTICULATE WOOD WASTE MATERIAL

This is a division of application Ser. No. 105,891, filed Dec. 21, 1979, now U.S. Pat. No. 4,307,702.

BACKGROUND OF THE INVENTION

1. Field of the Invention

The present invention relates to wood waste burning systems, and somewhat more particularly to an improved grating structure for use in a furnace means charged with wet or dry wood waste materials.

2. Description of the Prior Art

Particulate wood waste materials, such as sawdust, hogged bark, wood chips, shavings, green twigs and the like are produced in large quantities in many industries. Disposal of such materials, particularly if it is moist or wet, in an efficient and pollution-free manner is a serious problem in such industries. Because such waste wood materials generally occupy a substantial volume and such materials are a potentially valuable heat source, disposal is generally undertaken by means of combustion.

In order to dispose of a high volume of wood waste materials in an efficient manner, a furnace for burning such materials must be capable not only of accommodating a large volume of material but must also be able to uniformly raise the temperature of such material to a level at which optimum combustion can occur and be able to supply adequate air or oxygen to allow complete combustion to occur. If the temperature achieved is too low to effectuate proper combustion, only a portion of the material to be disposed will burn, thereby not only diminishing disposal efficiency, but also requiring that the furnace be cleansed more frequently than if complete combustion occurred. If insufficient oxygen or air is supplied to the combustion chamber, a similar problem occurs.

A further aggravating fact in the disposal of waste wood materials is that frequently such materials are green, damp or even wet and thus must first be dried, then heated and finally ignited before complete combustion of such material can occur. This requires a relatively steep temperature gradient within the combustion chamber of a furnace so as to avoid undue delays between drying and ignition.

In addition to achieving a proper temperature in a furnace, other factors contribute to efficient and pollution-free burning of wood waste material, such as the rate at which such material is fed to the furnace, the material-to-air ratio in the material stream being charged to the combustion chamber and the amount of air turbulence available within the combustion chamber for uniformly heating, drying and igniting the material. A controlled wood waste burning system capable of monitoring and cooperatively adjusting each of these factors is disclosed and claimed in our U.S. Pat. No. 4,311,102, the teachings of which are incorporated herein by reference. The system disclosed in that patent comprises a rotary screw conveyor for bottom unloading of a waste wood material storage bin, a sensor monitoring material levels in the bin, a choke screw device for transferring a select amount of the waste material to a transport system comprising a rotary feed, which transfer a constant amount of the particulate material from the choke screw to a transport conduit, an adjustable blower which provides a select volume of air to the conduit to entrain the material deposited therein at an optimum material-to-air ratio, a furnace means fed by such conduit and wherein the material is combusted, along with integrated control circuitry for optimum operation of the overall system.

A typical present-day wood waste burning furnace means comprises an enclosed relatively large-volume chamber lined with a fire-resistant material and connected to a chimney stack. A relatively large volume of wood waste material to be burned is either manually or automatically loaded onto the floor of such chamber, doused with a flamable liquid, such as kerosene or oil, ignited and allowed to smolder for an indefinite period of time. This type of operation is ineffective to fully extract the maximum amount of heat energy in the wood material, produces excessive ashes, smoke and other pollutant in the chimney which contaminate the atmosphere and produces large amounts of solid combustion products that require furnace shut-down every one or two loading cycles for manual clean-out thereof. While other furnace systems are known, they typically cannot accommodate large volumes of waste wood products, particularly when such products are moist or damp.

SUMMARY OF THE INVENTION

It is an object of the present invention to provide an improved grating structure functioning as a hearth in a furnace means, such as a boiler furnace, for efficient and pollution-free burning of all types of partculate wood waste material. It is a further object of the invention to provide a grating structure having initially selectable openings therein to permit flow of turbulent heated air through the grating structure to develop a high-speed hot air stream contacting and/or suspending a mass of particulate wood waste material above an upper surface of the grating structure. In this manner, each particulate piece of the waste material is optionally heated, dried and ignited for a substantially smoke- and ash- free operation. During such air-waste material particle contact, the surface of each wood particle is heated to drive out any volatile matter therein and the moving air stream strips away such volatile matter so that additional matter can exit from the wood particle surface. Once the volatile matter is removed from a wood particle, it is uniformally heated to its ignition point and, in the presence of excess air or oxygen, combusts substantially without smoke or ash residue.

These and other objects, features and advantages are inventively achieved by providing an improved hearth or grating structure comprised of a plurality of parallelly arranged support beams transversing a boiler furnace floor at a distance above such floor, with a plurality of fire-bricks arranged in rows on such beams in abutting relation with one another and having a preselected size open area between at least some adjacent bricks or rows of bricks to permit flow of turbulent hot air through such open areas or spaces for optimized heating, drying and combustion of particulate wood waste materials pneumatically fed onto the upper surface of such grating structure. The support means may be T-beams, H-beams, I-beams, U-channels or other types of support having appropriate properties and dimensions. The bricks and/or brick rows are maintained a select distance apart from adjacent bricks or brick row by spacers which are also supported by the beams disposed beneath select portions of abutting bricks.

When the bricks are initially positioned and arranged on the support beams with the spacers in a select pattern, the dimension of the space between adjacent bricks or rows thereof can be choosen so as to provide a total cross sectional air flow area through the grating which produces optimum turbulence and temperature for heating, drying and combusting particulated wood waste material, whether wet or dry. It has been found that by providing a select pattern of predetermined size open areas between adjacent bricks or rows thereof, efficient non-polluting combustion of wet (containing up to 50 60% moisture) or dry wood waste material is achieved. The open areas cause the heated air fed below the grating structure to exit through the structure as a high-speed turbulent air stream which not only suspends the particulate material above the grating structure, drying and heating such material but also, because of its velocity, actually cools elements of the grating structure, while releasing heat to the particulate material for drying and combustion.

DESCRIPTION OF THE DRAWINGS

FIG. 3 is a partial sectional view taken along line III—III of FIG. 2.

FIG. 4 is a partial sectional view taken along line IV—IV of FIG. 2.

FIG. 5 is an enlarged, perspective view of an embodiment of a grating structure constructed in accordance with the principles of the invention.

DESCRIPTION OF THE PREFERRED EMBODIMENTS

Figure 1:
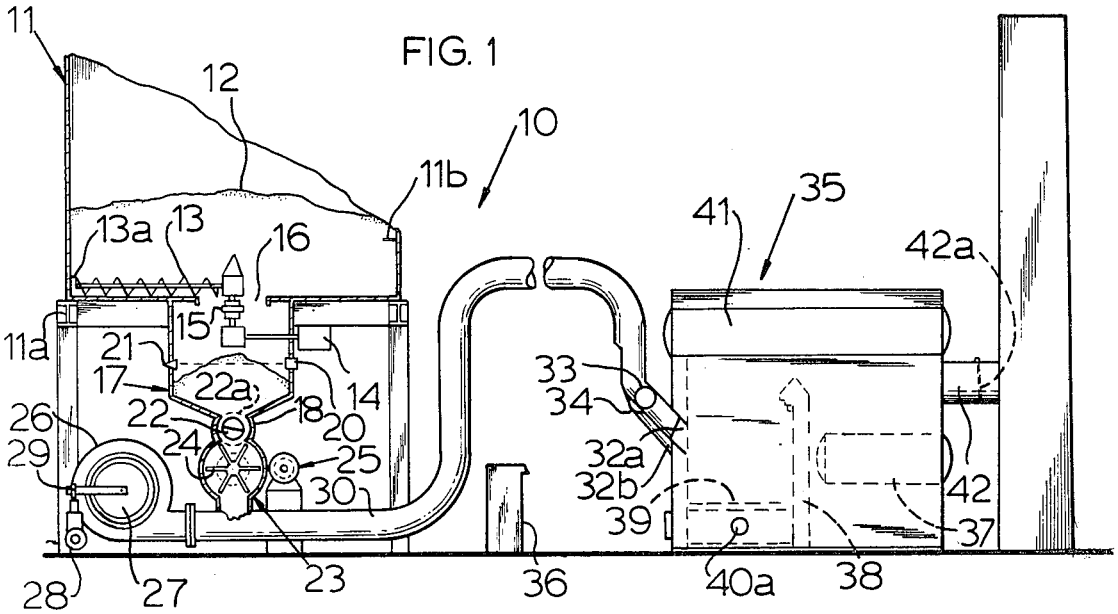
FIG. 1 is a partial side elevational, somewhat schematic view of a particulate wood waste burning system utilizing an improved grating structure constructed in accordance with the principles of the invention.
Figure 2:
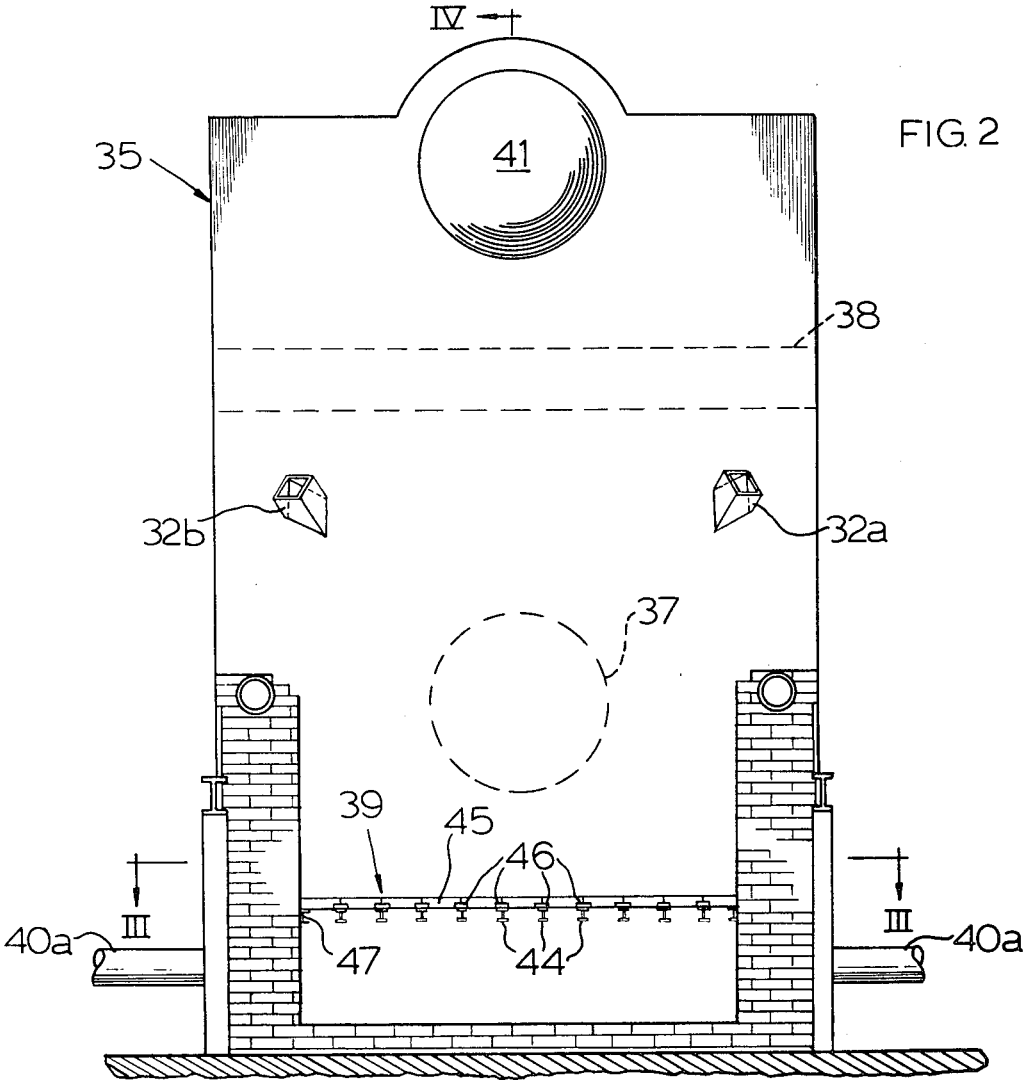
FIG. 2 is a partial sectional view of a furnace of the type utilized in the system of FIG. 1 having an improved grating structure of the invention therein.

A particulate wood waste material burning system is generally illustrated at 10 in FIG. 1. Briefly described, the system 10 comprises a storage bin 11 elevated on bin supports 11*a* and which contains particulate wood waste material 12 to be burned. The material 12, which may comprise dry, wet or green wood waste, such as hogged bark, sawdust, twigs and other like wood waste material, is unloaded from the bin 11 by means of a rotary screw conveyor 13 which is restrained along the bin floor by a retaining means 13*a* and is revolved around the base of the bin 11 by a motor 14 through a linkage 15. The screw conveyor 13 transfers material 12 through an opening 16 in the base of the bin 11 into an intermediate hopper 17. The intermediate hopper 17 is equipped with a sonic transmitter 20 and a sonic receiver 21 to monitor the level of material 12 in the hopper 17. The bin 11 may also be equipped with a suitable material monitoring device 11*b*, such as a weight or height sensor. Further details of this unloading system can be obtained from our U.S. Pat. Nos. 3,414,142 and 3,865,053, both of which are incorporated herein by reference.

The hopper 17 empties into a trough 18 which partially encloses a choke screw conveyor 22, provided with a shroud-like member 22*a* at the output end thereof for transferring a controlled amount of particulate wood waste material, from hopper 17 to the particulate material transport system (further details of such choke screw conveyor are disclosed in U.S. Pat. No. 2,723,021, which is incorporated herein by reference). The choke screw conveyor feeds the particulate material into a rotary feeder 23. The rotary feeder 23 is comprised of a generally cylindrical housing having a plurality of blades mounted on an axis for rotation within such chamber. A constant volume chamber is defined between adjacent blade members. Preferably, each blade terminates in a knife-edge so that any larger pieces of wood waste material protruding beyond such knife-edges are sheared and an air seal is formed between the respective blade edges and the inner housing wall of feeder 23. Controlled rotation of the blades 24 is effected via mechanical linkage between the axis on which the blades are mounted and motor-pulley means 25. During operation, the rotary feeder 23 transfers a unit constant amount of wood waste material to conduit 30 for admixing such material with a proper volume of air for optimized combustion. The air seal defined between each rotating blade of feeder 23 effectively separates the material storage and unloading system (elements 11 through 22) from the transport, charging and combustion system (elements 23 through 35), thereby providing a safeguard against back flow of gases and heat, such as may occur in the event of a malfunction of one or more elements.

An air flow is developed in the conduit 30 by a blower 26 having an adjustable intake 27 controlled by a motor 28 and linkage 29. Adjustment of the air intake 27 to the blower 26 results in a select volume of air in conduit 30 which entrains the material 12 deposited therein in a prescribed material-to-air ratio.

The conduit 30 is connected to a furnace means, which may comprise a fire tube or water tube boiler or industrial hot air furnace, industrial incinerator or heat-exchanger (using a heat-exchange medium, such as thermal oil, water or other suitable medium) and can be primarily or supplementarly fired by coal, gas, oil or other available fuel. The firing system for such furnace means and fuels are known so that further details thereof are unnecessary. In the embodiment shown, the furnace means is a boiler furnace 35 which, as shown, is connected to conduit 30 via dual conduit branches 32*a* and 32*b*. Each branch 32*a*, 32*b* is provided with a respective blow-back damper 33 and 34 as another safety feature to prevent reverse air or material flow from the furnace to the transport-charging system in the event of an explosion or malfunction in the furnace. Branches 32*a* and 32*b*, which comprise combustible material inputs, are aligned relative to one another and to the central area over grating structure 39 for optimum material distribution and for creation of optimum turbulence within the furnace combustion chamber. The boiler furnace 35 is provided with heat-extraction means, such as heat-exchange coils 37 and 41 for extracting heat from the furnace. At least some of the extracted heat can be utilized for heating air fed into the furnace beneath and/or above the grating structure 39 for heating, drying and combusting the particulate wood waste material fed to the furnace via branch conduits 32*a* and 32*b*. Of course, some extracted heat may be utilized for other heat applications. Typically, the heat exchange means within a boiler furnace comprise steam coils and which can be associated with dry-air coils (not shown) so that the steam heats the dry air and such heated dry air is fed via a conduit 40 (best seen at FIG. 3) under positive pressure into the furnace for contacting the waste wood material being combusted.

All of the parameters of the charging system, including the rate of unloading from the bin 11, the material levels in the bin 11 and the hopper 17, the feed rate of the choke screw conveyor 22, the feed rate of the rotary feeder 23, the volume of air intake to blower 26 and the steam pressure in coils 37 and 41 are all monitored and cooperatively controlled via suitable circuitry operationally interconnected within a control panel 36.

The boiler furnace 35 is provided with a grating structure or grate 39 constructed in accordance with the principles of the invention. The outer periphery of the grating structure 39, which typically is rectangularly-shaped (although other geometrically-shaped structures may be utilized), is comprised of parallel, spaced-apart support beams 44 and 47 having a plurality of parallel rows of bricks 45 positioned thereon as shown, and is supported a distance above a base floor of furnace 35 on three outer edges thereof by angle beams 47 attached to the corresponding outer walls 35*a* of furnace 35 and on the fourth, inner edge by a similar beam attached to a vertical wall 38 positioned within furnace 35, as shown. The wall 38 functions, in addition to a support means, as a guide for directing heated air within the furnace in a sinuous path to maximize contact between the hot air and the heat-extracting means within the furnace. Although the support beams 44 are shown as T-beams, H-beams, I-beams, U-channels or other support members having a flat upper load-bearing surface can also be used. Positioned below the grate 39 is at least one and preferably two hot air inlet conduits 40*a* and 40*b*. The hot air inlet conduits can be arranged in a staggered or off-set fashion relative to each other or in some other fashion for maximizing the amount of air turbulence generated by their respective air stream, keeping in mind the orientation of the material and air feed conduit branches 32*a* and 32*b*. Each hot air inlet is provided with an adjustable intake blower 51 (operated by motor 50) and is selectively connected to a hot air source, such as the heat-extraction means within the furnace via a valve-controlled conduit 40.

A plurality of heat-resistant fire bricks, for example composed of a fire or sintered refractory material, such as $Al_2O_3$ and typically being of a rectangular shape with dimensions of about 2"×4"×8" (it will be understood that the composition and dimensions of the bricks can vary as desired), are arranged in parallel rows extending across the beams 44 and 47. Each brick is supported at its respective ends by spaced-apart beams. The bricks may be orientated so that a major face (i.e., the top or bottom surface as defined by the length and width of each brick) contacts the support beams, as shown at FIG. 5 or some other brick orientation may be utilized. The bricks are merely enplaced, without cement or other anchoring or binding material, on the upper beam surfaces so that individual bricks are in surface contact with adjacent bricks within the row and at least some rows are spaced from at least one adjacent row. Such enplacement provides velocity-generating air flow spaces and allows repositioning and/or replacement of the bricks as necessary or desired.

Each row of bricks 45 can be positioned a select distance 53 from an adjacent row of bricks. The distance 53 can be uniform throughout the entire grating structure or may vary so that, for example, wider spaces 53*a* are provided along a central area of the grate and narrower spaces 53*b* are provided along outer edges of the grate. Of course, other patterns of open spaces between the brick rows may also be utilized.

The distance 53 between each adjacent row of bricks is defined and maintained by a plurality of spacers 46 positioned on the support beams 44 and between at least some adjacent brick rows. The spacers may comprise mild steel bar stock or be comprised of a refractory material similar to that of the bricks and be fashioned so as to have a select spacing dimension, for example, so as to be ¼" to ⅛" in thickness, (although another spacing dimension can be used, if desired).

The open spaces or areas formed by the pattern of support beams 44, spacers 46 and bricks 45 allow air flow through the grate 39 for improved drying, heating and combustion of wood waste material fed to furnace 35.

As best seen at FIG. 3, a valve-or damper-controlled conduit 40 is connected to a hot air supply, such as the heat-extraction means within the furnace 35 for selectively feeding hot air to a blower 51 operated by motor 50. The blower 51 can also be provided with a separate ambient air intake so that when relatively dry waste wood material is being combusted, the conduit 40 can be shut-off and only ambient air be fed beneath the grate 39. The air stream provided beneath the grate 39 flow upwardly at increased speeds because of the reduced flow space and causes turbulence within the combustion chamber. In instances where a hot air stream is fed beneath the grate, the turbulent, hot (about 250° to 400° F.) air stream initial contacts moist or wet wood waste material and first heats and dries the waste material, then heats it up to its ignition point and thereafter contributes oxygen for sustained combustion. Since a controlled amount of air (generally in excess of that required for combustion of a given volume of wood waste material) is fed to the combustion chamber of furnace 35 via a primary air source input, such as branch conduits 32*a* and 32*b*, and a controlled auxiliary amount of air is fed through the grate 39, a relatively large excess of oxygen is present within the combustion chamber promoting rapid combustion of any fuel and substantially raising the temperature of the combustion chamber (up to a maximum range of about 2000° to 2500° F.).

With an exemplary grating structure constructed in accordance with the principles of the invention and having spacers with a thickness or spacing dimension in the range of about ⅛" to ¼", approximately 10,000 B.T.U. were produced, when 7.33 pounds of air were introduced, along with an appropriate amount of a fuel into the combustion chamber of a boiler furnace equiped with such grating structure. With the foregoing parameters, the temperature of the combustion chamber above the upper brick surface was in the range of about 2000° to 2500° F. while the temperature just below the lower brick surface was in the range of about 400° to 600° F. and the temperature immediately below the support beams 44 was in the range of about 200° to 300° F. Thus, the temperature gradient developed within the area just below the bottom of beams 44 to just above the top of the bricks was approximately 2,250° F. but such steep temperature gradient did not harm the grating structure itself because of the velocity of the gas stream passing the various elements thereof. As will be appreciated, a moving gas stream, although containing a substantial amount of heat therein, nevertheless tends to cool any stationary structures that it flows past. Such steep temperature gradient, along with the induced turbulence acts on relatively moist or wet waste material particles by rapidly heating and drying such particles and then further heating them to ignition. The presence of excess air allows substantially complete combustion to occur without ash or smoke.

In a typical furnace provided with the grating structure of the invention and utilizing particulate wood waste material as fuel, continuous operation can occur for substantially extended periods of time without the necessity of furnace shutdown for cleaning-out of solid combustion products.

The select placement of bricks and spacers, along with the select orientation of the fuel material inputs and the primary and auxiliary air inlets (branch conduits 32*a*, 32*b* and air inlets 40*a* and 40*b*) provide an improved grating structure operable in a substantially pollution-free manner with wet or dry wood waste materials.

The furnace 35 has an outlet 42 connected to a chimney stack 43 for emission of exhaust gases. The stack 43 may be provided with a suitable damper 42*a* for aid in heat retention. The furnace 35 may be equipped with combustion efficiency sensors, such as an $O_2$-analyzer, a $Co_2$-analyzer or other combustion analyzers and with pollution control devices, such as a fly-ash arrestor, a scrubbed (dry or wet) or other equipment required by local air pollution governing agencies, as are known in the art. Such sensors and controlled devices are operationally interconnected with the integrated control circuitry of the overall system so as to be controlled and monitored by the control panel 36.

As is apparent from the foregoing specification, the present invention is susceptible of being embodied with various alterations and modifications which may differ particularly from those that have been described in the preceding specification and description. For example, additional air input conduits, either above or below the grating structure can be utilized for creating additional turbulence if desired. Further, the spacers may be omitted from certain portions of the grate area so that certain rows of bricks are in contact with one another while others are spaced apart. For these reasons, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. A furnace for burning particulate wood waste material comprising:

at least one steam coil connected to a steam source for heating air surrounding said coil;

a means for transferring said heating air to at least one air intake disposed at a lower portion of said furnace;

a means disposed at an upper portion of said furnace for charging said furnace with particulate wood waste material entrained in an air flow;

a plurality of spaced parallel beams supported across a combustion chamber in said furnace in a plane between said upper and lower portions of said chamber and sufficiently above said air intake for developing a turbulent air flow through said beams;

a plurality of spaced parallel rows of bricks, each said row comprised of a plurality of individual bricks arranged in an end-to-end fashion, perpendicular to and directly and removably supported by said beam in a single plane;

a plurality of spacers directly and removably supported on said beams and disposed between adjacent rows of bricks, said spacers maintaining a selected open area between said adjacent rows of bricks to permit flow of heated turbulent air from said air intake through the open areas defined by aid beams and bricks to contact and combust particulate wood waste material deposited on said bricks from said charging means, said selected open area being easily varied by changing the spacing between said bricks; and an exhaust means for disposing of gases formed by combustion of said particulate wood waste material.

2. The furnace of claim 1 wherein said selected open area between said adjacent rows of bricks is in the range of approximately $\frac{1}{8}$ inch to $\frac{1}{4}$ inch.

3. The furnace of claim 1 wherein said selected open area between said adjacent rows of bricks is uniform for all said rows of bricks.

4. The furnace of claim 6 wherein said plane in said furnace in which said spaced parallel beams lie has a central area and an outer area, said outer area disposed near the edges of said furnace, and wherein said selected open area between said adjacent rows of bricks is wider in said central area than said spacing in said outer area.

5. The furnace of claim 1 wherein said means for charging said furnace with particulate wood waste material comprises at least a pair of material inputs in said furnace disposed above said bricks and relative to each other such that respective streams of particulate wood waste material flowing from each input at least partially impinge against one another.

6. The furnace of claim 1 further comprising a heat exchange means including said steam coil for utilizing heat from the burned particulate wood waste material for heating said steam coil.

* * * * *